US009377276B1

(12) United States Patent
Jiang et al.

(10) Patent No.: US 9,377,276 B1
(45) Date of Patent: Jun. 28, 2016

(54) HANDHELD ANTI-RIOT DEVICE

(71) Applicants: THE 205TH ARSENAL, MATERIEL PRODUCTION CENTER, ARMAMENTS BUREAU, M.N.D., Kaohsiung (TW); TAIWAN DI TECHNOLOGY CO., LTD, Taipei (TW)

(72) Inventors: Ji-Sian Jiang, Kaohsiung (TW); Hsin-Hung Lin, Kaohsiung (TW); Chu-Chin Tsai, Kaohsiung (TW); Shr-Ming Tien, Kaohsiung (TW)

(73) Assignees: THE 205TH ARSENAL, MATERIEL PRODUCTION CENTER, ARMAMENTS BUREAU, M.N.D. (TW); TAIWAN DI TECHNOLOGY CO., LTD (TW)

( * ) Notice: Subject to any disclaimer, the term of this patent is extended or adjusted under 35 U.S.C. 154(b) by 0 days.

(21) Appl. No.: 14/749,687

(22) Filed: Jun. 25, 2015

(51) Int. Cl.
*F41H 13/00* (2006.01)

(52) U.S. Cl.
CPC ..... *F41H 13/0006* (2013.01); *F41H 13/0018* (2013.01); *F41H 13/0087* (2013.01)

(58) Field of Classification Search
CPC ..... F41H 13/0006; F41H 13/0018; F41H 13/0087
USPC ..... 89/1.34, 1.11
See application file for complete search history.

(56) References Cited

U.S. PATENT DOCUMENTS

| | | | | |
|---|---|---|---|---|
| 5,460,155 | A * | 10/1995 | Hobbs, II | F42B 12/68 124/1 |
| 6,091,597 | A * | 7/2000 | Lin | F41B 15/04 361/115 |
| 6,854,374 | B1 * | 2/2005 | Breazeale | F41H 5/08 102/502 |
| 7,305,981 | B1 * | 12/2007 | Lin | F41H 13/0006 124/59 |
| 8,857,305 | B1 * | 10/2014 | Tseng | F41B 11/80 124/71 |
| 2016/0040965 | A1 * | 2/2016 | Chang | F41H 13/0025 42/1.08 |

* cited by examiner

*Primary Examiner* — Reginald Tillman, Jr.
(74) *Attorney, Agent, or Firm* — Schmeiser, Olsen & Watts, LLP

(57) ABSTRACT

A handheld anti-riot device for throwing a catching net unit in a firing direction includes a cylindrical body, pressurized gas releasing unit, resilient ball, electric shock unit and illumination unit. The cylindrical body has therein a receiving chamber, limiting chamber and air passage in communication with each other. A net holder which holds the catching net unit is fixed to an opening of the receiving chamber. The pressurized gas releasing unit is disposed in the air passage. The resilient ball is snugly disposed in the limiting chamber. The electric shock unit generates a high-voltage electric arc. The illumination unit emits a blinding light ray in the firing direction. The pressurized gas releasing unit is triggered to release a pressurized gas into the air passage. The resilient ball gets compressed under the pressure inside the air passage to therefore move into the receiving chamber, thereby fire the catching net unit.

9 Claims, 5 Drawing Sheets

HANDHELD ANTI-RIOT DEVICE

FIELD OF TECHNOLOGY

The present invention relates to handheld anti-riot devices and, more particularly, to a handheld anti-riot device capable of firing a catching net, generating an electric shock and providing a blinding light ray.

BACKGROUND

Net guns are non-lethal anti-riot devices for use by police officers, soldiers and civilians (hereinafter referred collectively to as users) in capturing targets, such as robbers, enemies, and terrorists. Conventional net guns are capable of firing a catching net at a target to entangle the target and thus capture the target without causing serious harm to the target. However, in the situation where a target is in possession of a weapon, such as a handgun, it could be too late for a conventional net gun to fire the catching net at the target in order for the target to succumb, not to mention that the conventional net gun does not serve any defensive purpose.

SUMMARY

It is an objective of the present invention to provide a handheld anti-riot device which also serves a defensive purpose.

In order to achieve the above and other objectives, the present invention provides a handheld anti-riot device for firing a catching net unit. The handheld anti-riot device comprises a cylindrical body, a pressurized gas releasing unit, a resilient ball, a holding unit, an electric shock unit and an illumination unit. The cylindrical body has therein a receiving chamber, a limiting chamber and an air passage in communication with each other. The receiving chamber has an end with an opening which a net holder is fixed to. The net holder holds the catching net unit. The cylindrical body is provided with a trigger button outward. The pressurized gas releasing unit is disposed in the air passage and connected to the trigger button. The resilient ball is snugly disposed in the limiting chamber. The holding unit is coupled to the cylindrical body. The electric shock unit is disposed in the holding unit and has an electrode set for generating a high-voltage electric arc. The illumination unit is disposed in the holding unit and adapted to emit a blinding light ray in the same direction as the firing direction. A user presses the trigger button to allow the pressurized gas releasing unit to release a pressurized gas into the air passage such that the resilient ball gets compressed under a pressure inside the air passage to therefore move into the receiving chamber and hit the net holder, and thereby fire the catching net unit.

As regards the handheld anti-riot device, the illumination unit has a light-emitting component and is electrically connected to a power regulator adapted to regulate an electrical current sent to the light-emitting component.

As regards the handheld anti-riot device, the power regulator enables the light-emitting component to operate in an illumination mode or a flashing mode.

As regards the handheld anti-riot device, the pressurized gas releasing unit comprises a guiding support, a high-pressure bottle, a spring and a firing pin. The guiding support is coupled to the cylindrical body and movable between a first position inside the air passage and a second position inside the air passage. The first position is adjacent to the trigger button. The high-pressure bottle is fixed to the guiding support. The spring has one end coupled to the high-pressure bottle and another end fixed to the cylindrical body. The spring is compressed and thus abuts against the high-pressure bottle when the guiding support is located at the first position. The firing pin is fixed to the cylindrical body, located at the second position, and pointed at a mouth of the high-pressure bottle.

As regards the handheld anti-riot device, the trigger button has a limiting pin and a leaf spring, with the limiting pin penetrating the cylindrical body and sticking into the air passage, wherein the leaf spring abuts against the limiting pin and the cylindrical body resiliently such that the limiting pin limits movement of a protruding portion of the guiding support.

As regards the handheld anti-riot device, the limiting chamber has a smaller cross-sectional area than the air passage.

Hence, the handheld anti-riot device fires the catching net unit at a target to entangle the target and thus capture the target, has the electric shock unit for generating an electric shock to incapacitate a target at a close range, and has the illumination unit for emitting a blinding light ray to blind the target temporarily and thus prevent the target from attacking the user or escaping.

BRIEF DESCRIPTION

Objectives, features, and advantages of the present invention are hereunder illustrated with specific embodiments in conjunction with the accompanying drawings, in which.

DETAILED DESCRIPTION

Figure 1:
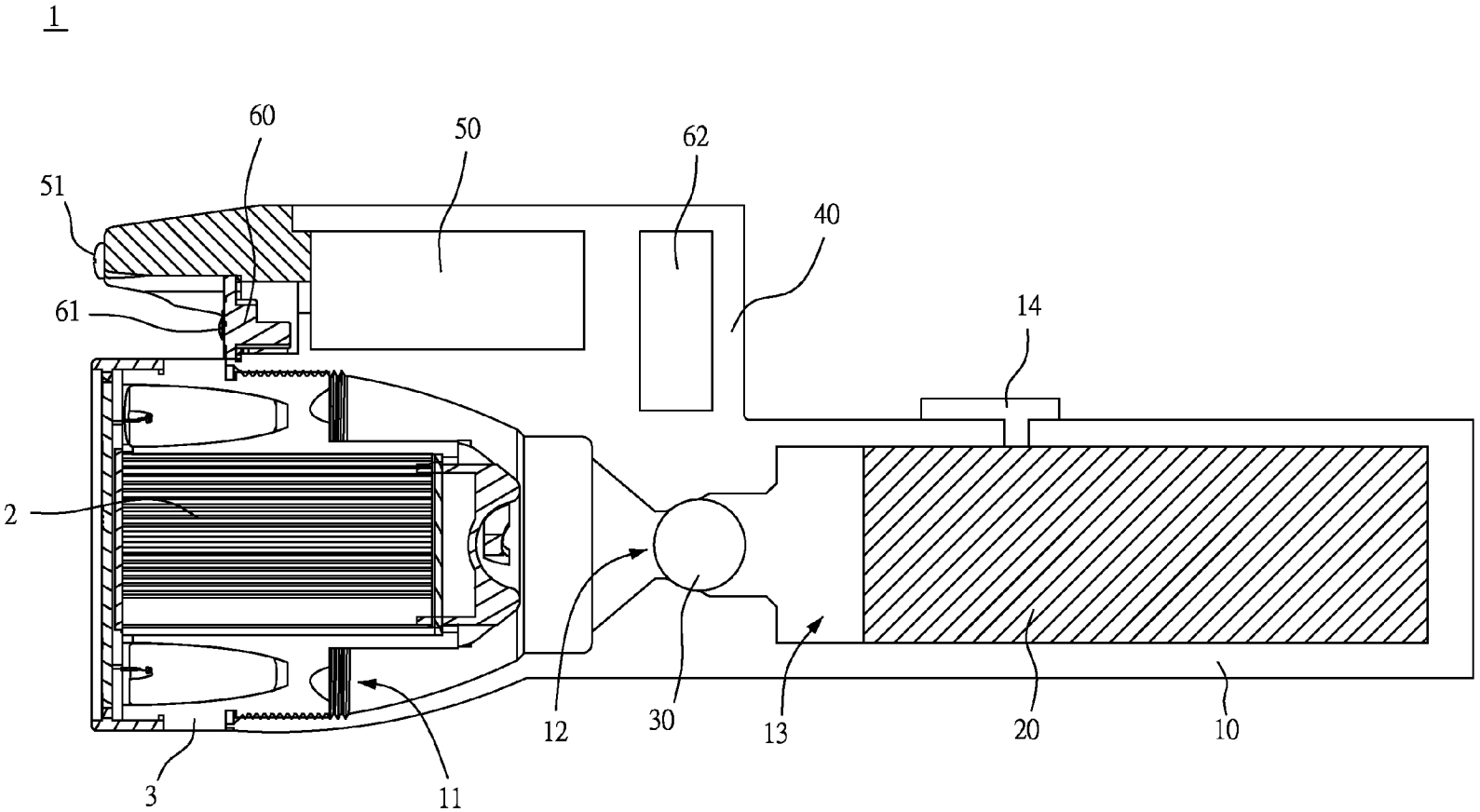
FIG. 1 is a cross-sectional view of a handheld anti-riot device according to an embodiment of the present invention.

Referring to FIG. 1, in an embodiment of the present invention, a handheld anti-riot device 1 for use in throwing a catching net unit 2 in a firing direction can catch a target, such as a suspect or a rioter.

The handheld anti-riot device 1 comprises a cylindrical body 10, a pressurized gas releasing unit 20, a resilient ball 30, a holding unit 40, an electric shock unit 50 and an illumination unit 60.

The cylindrical body 10 has therein a receiving chamber 11, a limiting chamber 12, and an air passage 13 which are in communication with each other. The receiving chamber 11 has one end with an opening which a net holder 3 is fixed to. The net holder 3 holds the catching net unit 2. The cylindrical body 10 is provided with a trigger button 14 outward. The pressurized gas releasing unit 20 is disposed in the air passage 13 and connected to the trigger button 14. The resilient ball 30 is snugly disposed in the limiting chamber 12. The holding unit 40 is coupled to the cylindrical body 10. The electric shock unit 50 is disposed in the holding unit 40 and has an electrode set 51 for generating a high-voltage electric arc. The illumination unit 60 is disposed in the holding unit 40. The illumination unit 60 emits a blinding light ray in the same direction as the firing direction.

Figure 2:
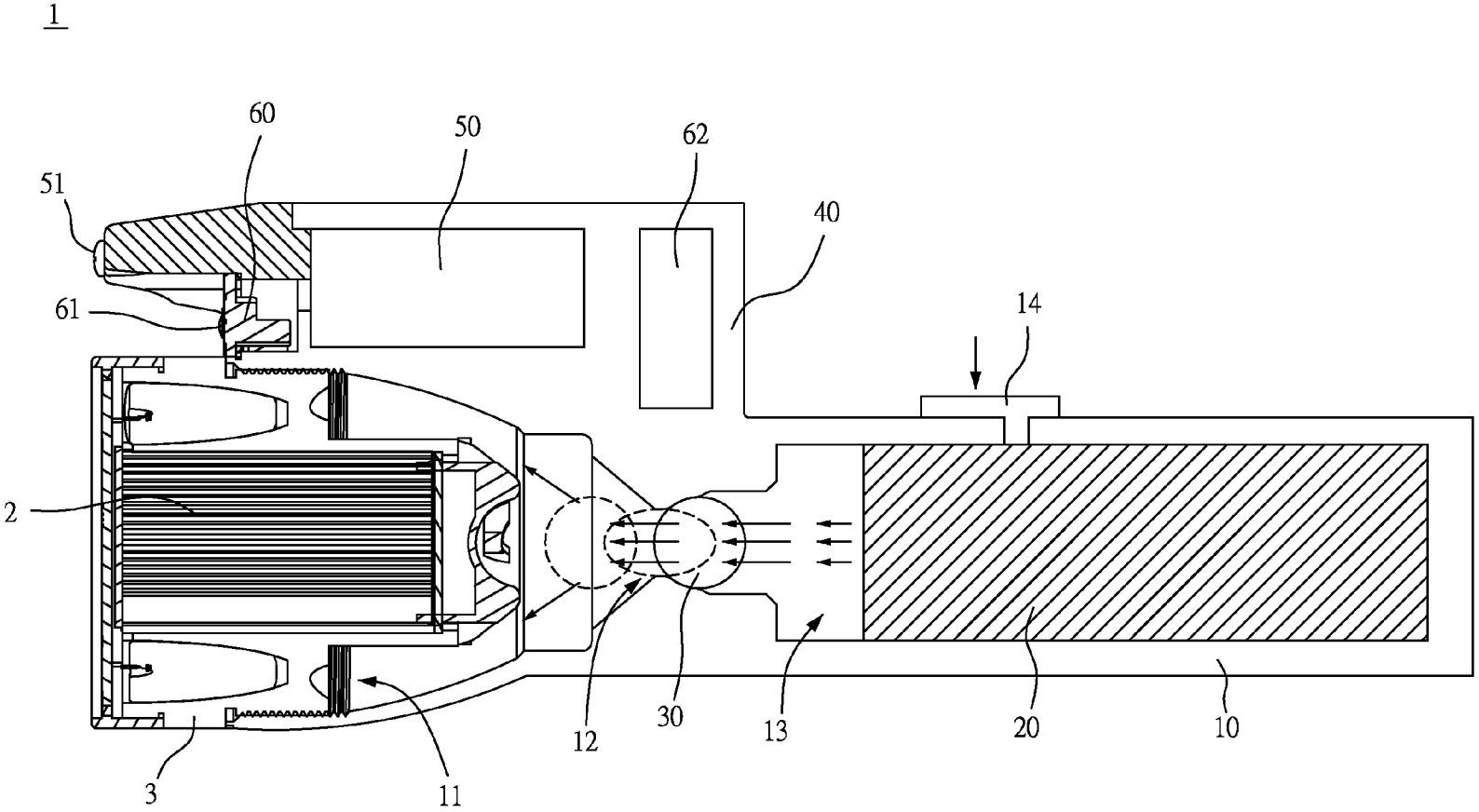
FIG. 2 is a cross-sectional view of the handheld anti-riot device shown in FIG. 1, depicting its operation.
Figure 3:
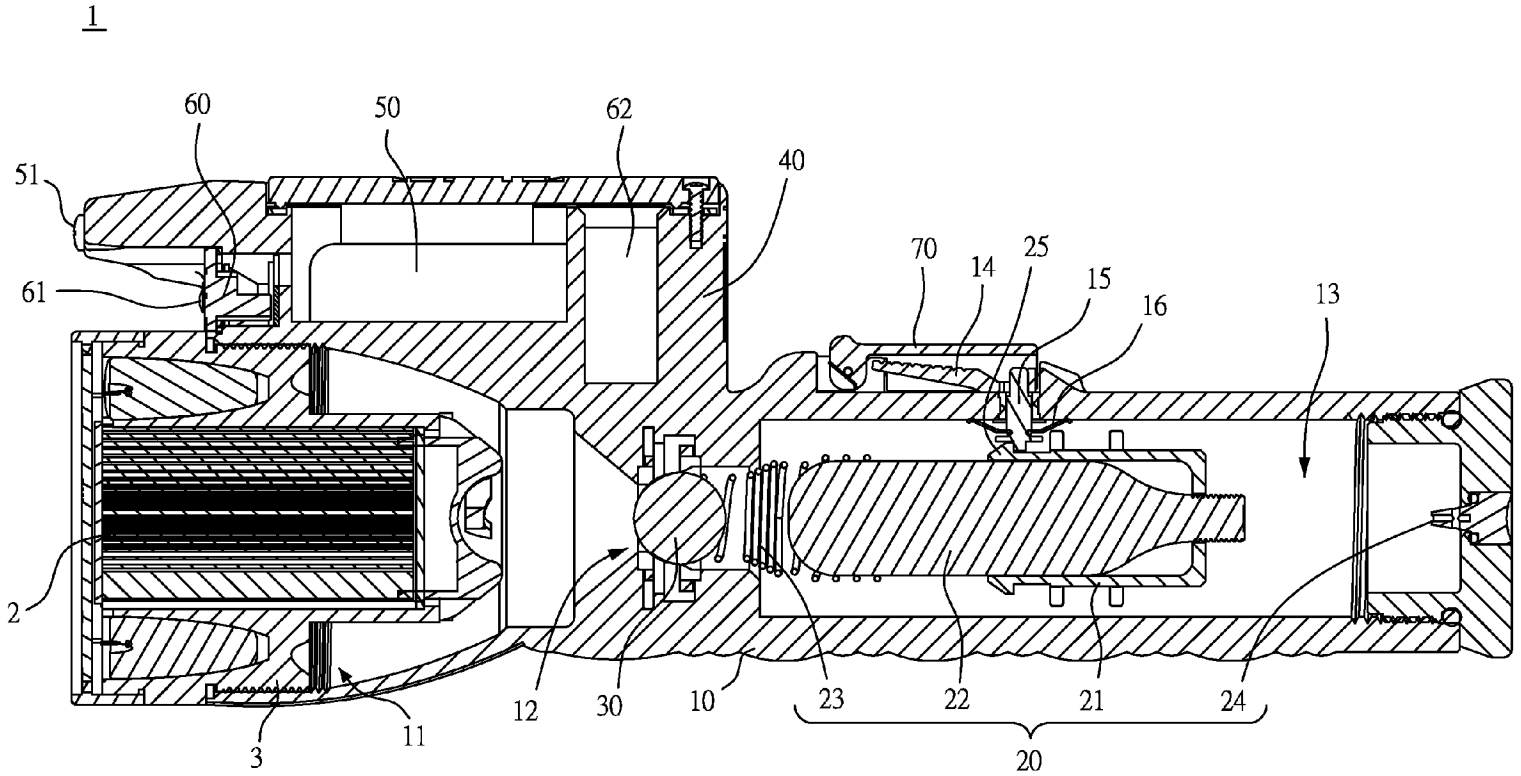
FIG. 3 is a cross-sectional view of the handheld anti-riot device according to another embodiment of the present invention.

As shown in FIG. 2, to start the handheld anti-riot device 1, a user presses the trigger button 14 and thus causes the pressurized gas releasing unit 20 to release a pressurized gas into the air passage 13. As a result, the resilient ball 30 gets compressed and deformed under the pressure of the pressurized gas inside the air passage 13 to therefore move from the limiting chamber 12 into the receiving chamber 11 to hit the net holder 3, and thereby fire the catching net unit 2.

The limiting chamber 12 has a smaller cross-sectional area than the air passage 13. Hence, the pressurized gas moves from the air passage 13 to the limiting chamber 12 at an increasing speed.

In this embodiment, the resilient ball 30 is made of a resilient material, such as rubber. The resilient ball 30 is snugly disposed in the limiting chamber 12 to not only separate the receiving chamber 11 from the air passage 13 but also cause the air passage 13 to form an airtight space.

The illumination unit 60 emits a blinding light ray to temporarily blind the target. Hence, the handheld anti-riot device 1 also serves a defensive purpose.

The illumination unit 60 has a light-emitting component 61 and is electrically connected to a power regulator 62. The power regulator 62 regulates the electrical current sent to the light-emitting component 61 such that the light-emitting component 61 in operation can switch between different illumination modes which provide different degrees of illumination, respectively. Preferably, the power regulator 62 enables the light-emitting component 61 to operate in an illumination mode and a flashing mode. Hence, the light-emitting component 61 operates in the illumination mode to emit light continuously for use in illumination or operates in the flashing mode to emit light intermittently for use in giving an alert.

Referring to FIG. 2, in this embodiment, the pressurized gas releasing unit 20 of the handheld anti-riot device 1 comprises a guiding support 21, a high-pressure bottle 22, a spring 23 and a firing pin 24. The guiding support 21 is coupled to the cylindrical body 10 while being movable between a first position inside the air passage 13 and a second position inside the air passage 13. The first position is adjacent to the trigger button 14. The high-pressure bottle 22 is fixed to the guiding support 21. The guiding support 21 is pipe-like and fitted to the high-pressure bottle 22. Rails are externally disposed at the guiding support 21 and movably coupled to grooves disposed on the inner wall of the air passage 13, respectively; hence, the guiding support 21 is capable of undergoing linear movement in a direction parallel to the longitudinal axis of the cylindrical body 10.

The spring 23 has one end coupled to the high-pressure bottle 22. The other end of the spring 23 is fixed to the cylindrical body 10 and positioned proximate to the junction of the air passage 13 and the limiting chamber 12. When the guiding support 21 is located at the first position inside the air passage 13, the spring 23 is compressed and thus abuts against the high-pressure bottle 22 to therefore exert a resilience force upon the high-pressure bottle 22. Under the resilience force, the high-pressure bottle 22 has a tendency to move away from the first position.

The firing pin 24 is fixed to the cylindrical body 10 and located at the second position inside the air passage 13. The firing pin 24 is pointed at the mouth of the high-pressure bottle 22. The firing pin 24 penetrates the mouth of the high-pressure bottle 22 as soon as the high-pressure bottle 22 moves to the second position inside the air passage 13, so as to release the pressurized gas otherwise confined to the high-pressure bottle 22.

In this embodiment, the trigger button 14 has a limiting pin 15 and a leaf spring 16. The limiting pin 15 penetrates the cylindrical body 10 and sticks into the air passage 13. The leaf spring 16 abuts against the limiting pin 15 and the cylindrical body 10 resiliently such that the limiting pin 15 limits movement of a protruding portion 25 of the guiding support 21.

Figure 4:
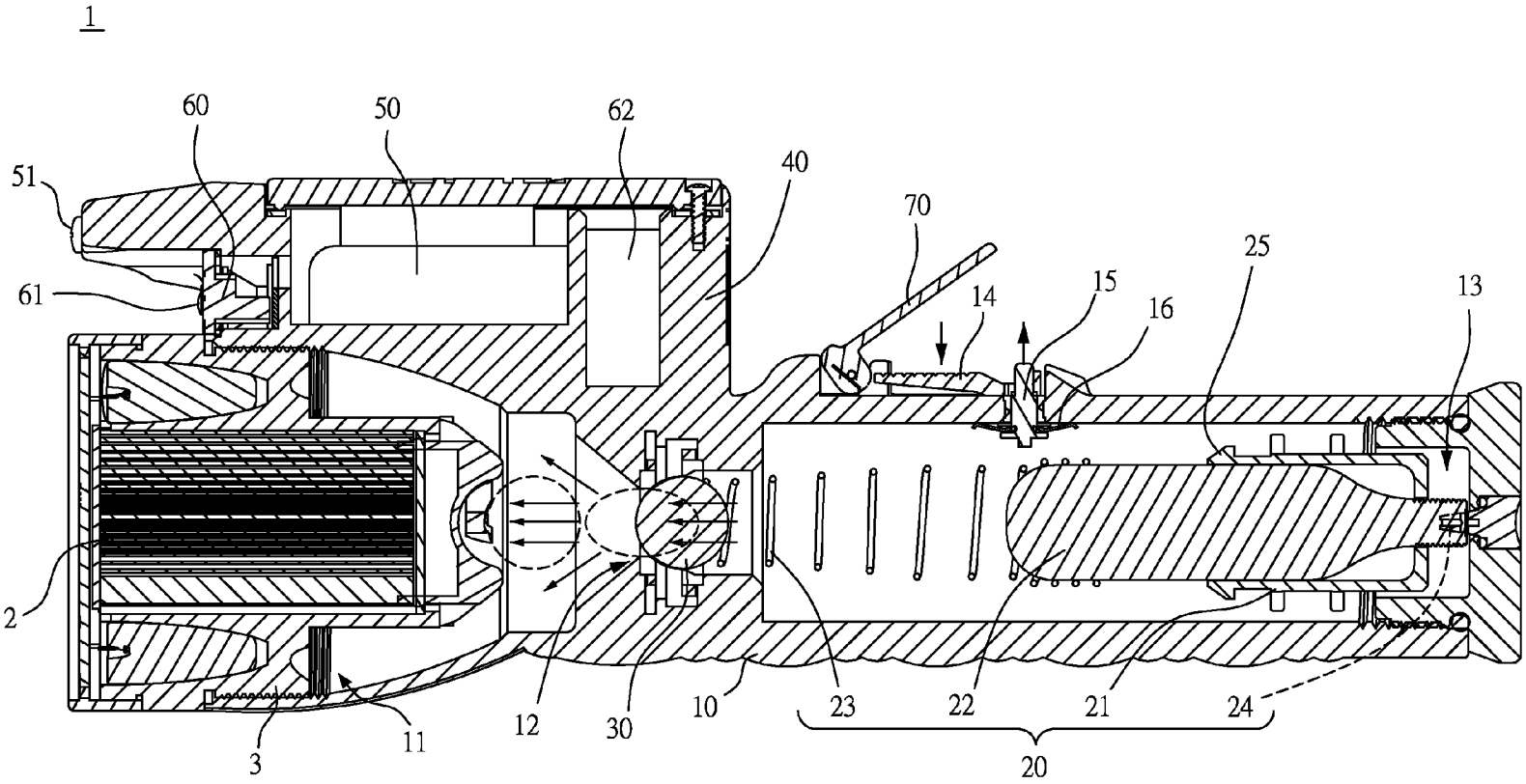
FIG. 4 is a cross-sectional view of the handheld anti-riot device shown in FIG. 3, depicting its operation.

As shown in FIG. 4, when the user presses the trigger button 14, the limiting pin 15 moves upward and thus compresses the leaf spring 16 such that the limiting pin 15 no longer limits movement of the protruding portion 25 of the guiding support 21. Since the high-pressure bottle 22 is subjected to a resilience force exerted by the spring 30, both the high-pressure bottle 22 and the guiding support 21 move from the first position to the second position inside the air passage 13, and in consequence the firing pin 24 hits the mouth of the high-pressure bottle 22. As a result, the pressurized gas is released and conveyed to the air passage 13, and thereby causing the pressure in the air passage 13 to increase until the resilient ball 30 is compressed and deformed. When deformed, the resilient ball 30 moves from the limiting chamber 12 to the receiving chamber 11 to therefore hit the catching net unit 2 in the net holder 3, and thereby fire the catching net unit 2.

Figure 5:
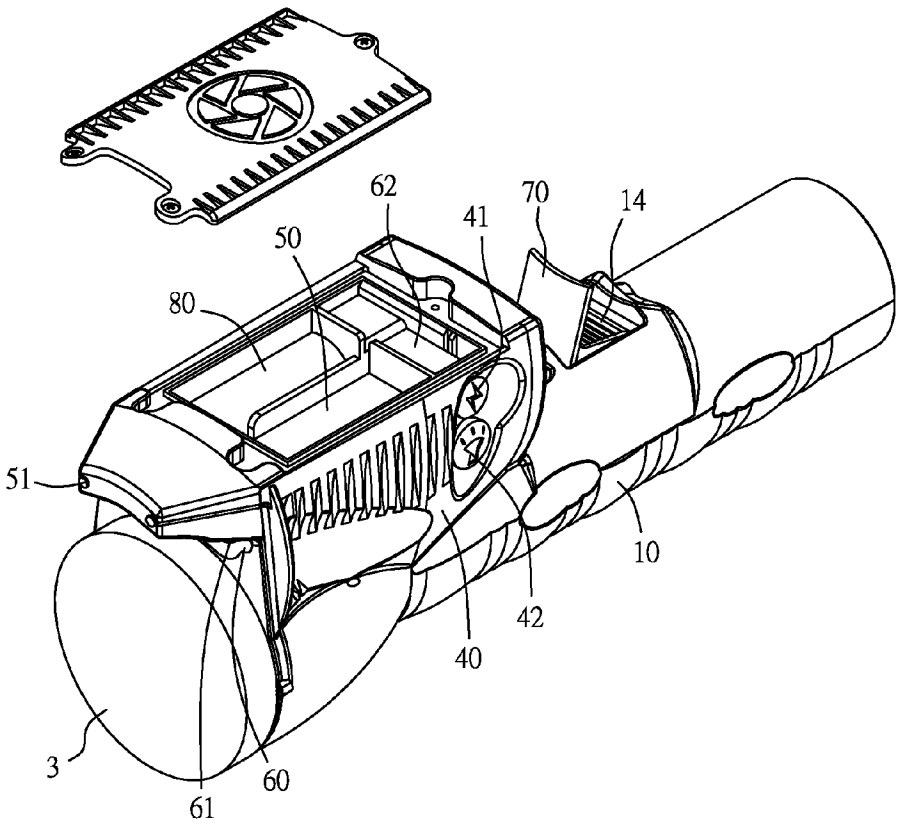
FIG. 5 is a perspective view of the handheld anti-riot device shown in FIG. 3.

As shown in FIG. 5, a protective lid 70 is pivotally coupled to the cylindrical body 10 to thereby hide the trigger button 14, preventing the trigger button 14 from being inadvertently pressed and thus the catching net unit 2 from being inadvertently fired. To expose and press the trigger button 14, the user opens the protective lid 70.

In addition, the holding unit 40 has switch buttons 41, 42. The switch button 41 is electrically connected to the electric shock unit 50 to turn on or off the electric shock unit 50. The switch button 42 is electrically connected to the illumination unit 60 to turn on or off the illumination unit 60.

In this embodiment, the electric shock unit 50 and the illumination unit 60 share a power source 80, but the present invention is not limited thereto. In another embodiment, the electric shock unit 50 and the illumination unit 60 each come in the form of a module equipped with a self-contained power source.

Hence, in this embodiment, the handheld anti-riot device 1 fires the catching net unit 2 at a target to entangle the target and thus capture the target, has the electric shock unit 50 for generating an electric shock to incapacitate a target at a close range, and has the illumination unit 60 for emitting a blinding light ray to blind the target temporarily and thus prevent the target from attacking the user or escaping.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A handheld anti-riot device for throwing a catching net unit in a firing direction, comprising:

a cylindrical body having therein a receiving chamber, a limiting chamber and an air passage in communication with each other, the receiving chamber having an end with an opening which a net holder is fixed to, the net holder holding the catching net unit, and the cylindrical body being provided with a trigger button outward;

a pressurized gas releasing unit disposed in the air passage and connected to the trigger button;

a resilient ball snugly disposed in the limiting chamber;

a holding unit coupled to the cylindrical body;

an electric shock unit disposed in the holding unit and having an electrode set for generating a high-voltage electric arc; and an illumination unit disposed in the holding unit and adapted to emit a blinding light ray in the same direction as the firing direction, wherein a user presses the trigger button to allow the pressurized gas releasing unit to release a pressurized gas into the air passage such that the resilient ball gets compressed under a pressure inside the air passage to therefore move into the receiving chamber and hit the net holder, and thereby fire the catching net unit.

2. The handheld anti-riot device of claim 1, wherein the illumination unit has a light-emitting component and is electrically connected to a power regulator adapted to regulate an electrical current sent to the light-emitting component.

3. The handheld anti-riot device of claim 2, wherein the power regulator enables the light-emitting component to operate in one of an illumination mode and a flashing mode.

4. The handheld anti-riot device of claim 2, wherein the pressurized gas releasing unit comprises:

a guiding support coupled to the cylindrical body and movable between a first position inside the air passage and a second position inside the air passage, wherein the first position is adjacent to the trigger button;

a high-pressure bottle fixed to the guiding support;

a spring with one end coupled to the high-pressure bottle and another end fixed to the cylindrical body, wherein the spring is compressed and thus abuts against the high-pressure bottle when the guiding support is located at the first position; and a firing pin fixed to the cylindrical body, located at the second position, and pointed at a mouth of the high-pressure bottle.

5. The handheld anti-riot device of claim 4, wherein the trigger button has a limiting pin and a leaf spring, with the limiting pin penetrating the cylindrical body and sticking into the air passage, wherein the leaf spring abuts against the limiting pin and the cylindrical body resiliently such that the limiting pin limits movement of a protruding portion of the guiding support.

6. The handheld anti-riot device of claim 5, wherein the limiting chamber has a smaller cross-sectional area than the air passage.

7. The handheld anti-riot device of claim 1, wherein the pressurized gas releasing unit comprises:

a guiding support coupled to the cylindrical body and movable between a first position inside the air passage and a second position inside the air passage;

a high-pressure bottle fixed to the guiding support;

a spring with one end coupled to the high-pressure bottle and another end fixed to the cylindrical body, wherein the spring is compressed and thus abuts against the high-pressure bottle when the guiding support is located at the first position; and a firing pin fixed to the cylindrical body, located at the second position, and pointed at a mouth of the high-pressure bottle.

8. The handheld anti-riot device of claim 7, wherein the trigger button has a limiting pin and a leaf spring, with the limiting pin penetrating the cylindrical body and sticking into the air passage, wherein the leaf spring abuts against the limiting pin and the cylindrical body resiliently such that the limiting pin limits movement of a protruding portion of the guiding support.

9. The handheld anti-riot device of claim 8, wherein the limiting chamber has a smaller cross-sectional area than the air passage.

* * * * *